United States Patent [19]

Ullmann et al.

[11] 4,197,968

[45] Apr. 15, 1980

[54] SYNTHETIC-RESIN AND METALLIC LAYERED WATCHBAND

[75] Inventors: Roland Ullmann, Hausen; Klaus Zimmermann, Bremthal, both of Fed. Rep. of Germany

[73] Assignee: Braun AG, Frankfurt am Main, Fed. Rep. of Germany

[21] Appl. No.: 901,703

[22] Filed: May 1, 1978

[30] Foreign Application Priority Data

May 2, 1977 [DE] Fed. Rep. of Germany ..... 2719480

[51] Int. Cl.[2] ..... A45C 11/10

[52] U.S. Cl. ..... 224/178; 63/3; 24/73 WW

[58] Field of Search ..... 224/4 D, 4 E, 4 F, 4 J, 224/4 K, 4 C, 4 R, 28 R, 28 B, 28 W; 2/338; 29/21.1, 160.6, 514; 63/2, 3, 9, 11; 24/265 WS, 73 WW, 3 A

[56] References Cited

U.S. PATENT DOCUMENTS

| | | | |
|---|---|---|---|
| 1,319,337 | 10/1919 | Helmann | 2/338 |
| 1,750,125 | 3/1930 | Prestinari | 63/3 |
| 3,362,595 | 1/1968 | Herzog | 224/4 D |
| 3,540,109 | 11/1970 | Marthaler | 29/160.6 |

FOREIGN PATENT DOCUMENTS

| | | | |
|---|---|---|---|
| 839131 | 3/1952 | Fed. Rep. of Germany | 224/4 K |
| 1257561 | 3/1960 | France | 63/3 |
| 2222969 | 10/1974 | France | 224/4 J |

*Primary Examiner*—Kenneth W. Noland
*Attorney, Agent, or Firm*—Karl F. Ross

[57] ABSTRACT

A watchband is formed of two contiguous strips, an outer nonmetallic strip, normally of a synthetic resin, and an inner metal strip. The metal strip is formed with an array of throughgoing perforations over substantially all of its surface and the nonmetallic strip is formed with a multiplicity of bosses each projecting through a respective perforation and extending beyond the inner face of the metal strip so that the band will rest via these bosses against the skin of the wearer.

8 Claims, 2 Drawing Figures

SYNTHETIC-RESIN AND METALLIC LAYERED WATCHBAND

FIELD OF THE INVENTION

The present invention relates to a bracelet. More particularly this invention concerns a bracelet usable as a watchband.

BACKGROUND OF THE INVENTION

It is known to use a metallic bracelet as a watchband. Such a watchband is considered quite attractive and has the advantage of a long service life. Such a watchband, however, is often found to be uncomfortable, first of all because the hard metal can pinch or cut into the skin of the wearer, and secondly because the nonporous nature of the metallic band does not allow sweat to dissipate.

A nonmetallic watchband is also known, normally made of a synthetic-resin strip or of a textile. Such a watchband is considered quite comfortable, but is often found unattractive due to its softness. Furthermore the service life of such a watchband is often short, as the material forming it is relatively soft and wears out rapidly.

OBJECTS OF THE INVENTION

It is therefore an object of the present invention to provide an improved bracelet.

Another object is the provision of a bracelet usable as a watchband which overcomes the above-given disadvantages.

A further object is to provide a watchband which will have a long service life, while at the same time being comfortable and attractive.

SUMMARY OF THE INVENTION

These objects are attained according to the invention in a bracelet comprising a metal—normally steel or aluminum—strip laminated with a nonmetallic—normally synthetic-resin or textile—strip. In accordance with this invention the metal strip has an inner face normally turned toward the wrist of the wearer and an outer face, and is formed with a multiplicity of throughgoing perforations over substantially all of its surface. The nonmetallic strip lies against the outer face and has a multiplicity of bosses or projections that each extend through a respective perforation and extend inwardly beyond the inner face of the metallic inner strip.

Thus the bracelet according to this invention when used as a watchband will lie against the wrist of the wearer substantially exclusively via the heads of the projections which extend beyond the smooth inner face of the inner metal strip. A smooth and nonporous metal surface does not lie against the wearer's skin so that sweat buildup under the watchband is avoided. At the same time the metallic strip imparts a substantial stiffness, and hence a nice appearance, as well as a long service life to the watchband.

According to further features of this invention the array is substantially uniform, although it lies within the scope of the present invention to pattern the array for decorative effect. The strips may also each be formed of a succession of links or small plates without departing from the basic principle of the invention.

In accordance with yet another features of this invention the two strips are contiguous and bonded together either by vulcanization or by means of an adhesive. It is also possible to dimension the projections slightly larger than their perforations and to force fit the two strips together, or to upset the inwardly projecting ends of the bosses, rivet-fashion, to secure the two strips together.

SPECIFIC DESCRIPTION

Figure 1:
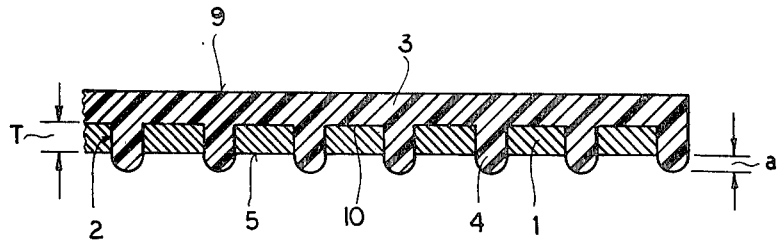
FIG. 1 is a longitudinal large-scale section through a portion of a bracelet according to the instant invention.
Figure 2:
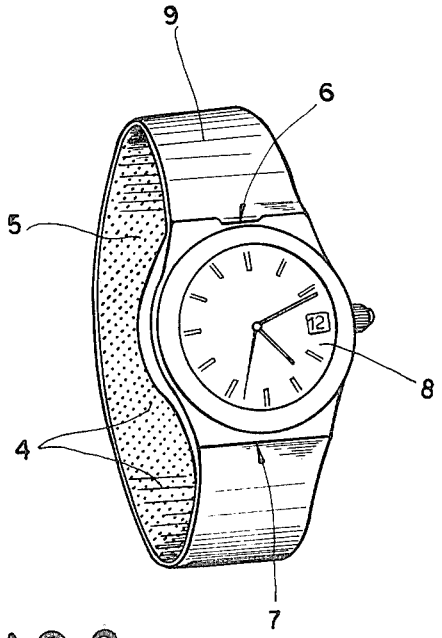
FIG. 2 is a perspective view of a wristwatch having a watchband according to the present invention.

As shown in FIG. 1 a watchband according to this invention basically comprises an elongated inner metallic, here aluminum, strip 1 and contiguous therewith a synthetic-resin, here Nylon, strip 3. The metallic strip 1 is formed with an array of throughgoing cylindrical perforations 2 and the strip 3 is formed with a multiplicity of cylindrical bosses 4 that each extend through a respective perforation 2 and project beyond the inner face 5 of the strip 1 by a distance a equal to between one-quarter and three-quarters of the thickness T of the strip 1, which is of the same thickness the strip 3. Thus the watchband has an outer face 9 on the strip 3 which is the face normally seen and an interface 10 is formed between the inner face of the outer strip 3 and the outer face of the inner strip 1.

In accordance with this invention the two strips 1 and 3, which may each be formed of a plurality of linked-together plates, may be interconnected by vulcanization of the synthetic-resin or elastomeric strip 3 on the strip 1, or the bosses 4 may be dimensioned slightly larger than the perforations 2 and/or their heads upset rivet-fashion to secure the two strips 1 and 3 together. The strip 3 may also be formed at least partially of a textile. The holes 2 may be provided as shown in a uniform array, or patterned array may be used for artistic effect.

Such a layered bracelet is provided on its ends 6 and 7 with fittings for connection to a wristwatch case 8, one of the ends 6 being made easily disconnectable for donning and removing the wristwatch.

We claim:

1. A bracelet comprising:
   - a substantially continuous and one-piece flexible metal strip formed with a generally uniform array of perforations over generally all of its surface and having an inner face and an outer face; and
   - a flexible synthetic-resin strip overlying said metal strip at said outer face thereof and unitarily formed with a multiplicity of bosses each extending through a respective perforation and each forming a bump extending beyond said inner face, said bumps extending by a distance such that when the bracelet is worn about the wrist the bumps provide for ventilation of the wrist between the bumps.

2. The bracelet defined in claim 1 wherein said nonmetallic strip only extends through said metal strip at said perforations thereof.

3. The bracelet defined in claim 1 wherein said strips are bonded together at said outer face.

4. The bracelet defined in claim 1 wherein said bosses are upset rivet-fashion at said inner face to secure said strips together.

5. The bracelet defined in claim 1 wherein at least one of said strips has ends provided with fittings for connection to a wristwatch case.

6. The bracelet defined in claim 1 wherein said bosses project beyond said inner face by a distance equal to between one-quarter and three-quarters of the thickness of said metal strip.

7. The bracelet defined in claim 6 wherein said strips are of substantially the same thickness.

8. A bracelet comprising:

a flexible metal strip formed with an array of perforations over generally all of its surface, having a predetermined thickness, and having an inner face and an outer face; and a flexible synthetic-resin strip overlying said metal strip at said outer face thereof and unitarially formed with a multiplicity of bosses each extending through a respective perforation and extending beyond said inner face by a distance equal to between one-quarter and three-quarters of said thickness, at least one of said strips having ends provided with fittings for connection to a wristwatch case.

* * * * *